US011353266B2

(12) United States Patent
Sabau et al.

(10) Patent No.: US 11,353,266 B2
(45) Date of Patent: Jun. 7, 2022

(54) MULTI-ZONE SHELL AND TUBE HEAT EXCHANGER

(71) Applicant: UT-BATTELLE, LLC, Oak Ridge, TN (US)

(72) Inventors: Adrian S. Sabau, Knoxville, TN (US); James W. Klett, Knoxville, TN (US); Yarom Polsky, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 43 days.

(21) Appl. No.: 17/036,392

(22) Filed: Sep. 29, 2020

(65) Prior Publication Data

US 2022/0099377 A1 Mar. 31, 2022

(51) Int. Cl.
*F28D 7/00* (2006.01)
*F28D 7/10* (2006.01)

(52) U.S. Cl.
CPC ..... *F28D 7/10* (2013.01)

(58) Field of Classification Search
CPC ..... F28D 7/10
USPC ..... 165/159
See application file for complete search history.

(56) References Cited

U.S. PATENT DOCUMENTS 3,830,293 A * 8/1974 Bell ..... F28B 1/00 165/174
2016/0018168 A1* 1/2016 Urbanski ..... F28D 7/16 165/159

FOREIGN PATENT DOCUMENTS

CN 1987325 A 6/2007

OTHER PUBLICATIONS

I.G. Wright, B. A. Pint, J. P. Shingledecker and D. Thimsen, Materials Considerations for Supercritical CO2 Turbine Cycles, Paper No. GT2013-94941, pp. V008T34A010; ASME Turbo Expo 2013: Turbine Technical Conf. and Expo., vol. 8, San Antonio, Texas, USA, Jun. 3-7, 2013.

R. J. Allam, J. E. Fetvedt, B. A. Forrest and D. A. Freed,The Oxy-Fuel, Supercritical CO2 Allam Cycle: New Cycle Developments to Produce Even Lower-Cost Electricity From Fossil Fuels Without Atmospheric Emissions, Paper No. GT2014-26952, pp. V03BT36A016, ASME Turbo Expo 2014: Turbine Technical Conference and Exposition, vol. 3B, Düsseldorf, Germany, Jun. 16-20, 2014.

(Continued)

*Primary Examiner* — Davis D Hwu
(74) *Attorney, Agent, or Firm* — Fox Rothschild LLP

(57) ABSTRACT

A shell and tube heat exchanger has elongated shell having first and second opposing ends and an open interior. A core divides the open interior of the shell into first and second enclosed portions. The shell has first and second tube fluid openings at opposing ends. End plates divide the first and second enclosed portions into manifold portions and enclosed shell chamber portions. Tubes extend from the end plates, through the enclosed shell chambers to the core. Shell fluid openings are at sides of the elongated shell, a first fluid opening communicating with the first shell chamber, and a second fluid opening communicating with the second shell chamber. The shell has a long axis, and the end plates are angled relative to the long axis. The tubes are polygonal with rounded corners and straight sides. The heat exchanger can be used for both evaporation and condensation processes.

27 Claims, 13 Drawing Sheets

(56) References Cited

OTHER PUBLICATIONS

Teguh, P. Bambang, and M. D. Trisno. "Model of binary cycle power plant using brine as thermal energy sources and development potential in Sibayak." International Journal of Electrical & Computer Sciences IJECS-IJENS 11 (2011): 02.
Nigusse, Haile Araya, Hiram M. Ndiritu, and Robert Kiplimo. "Performance Assessment of a Shell Tube Evaporator for a Model Organic Rankine Cycle for Use in Geothermal Power Plant." Journal of Power and Energy Engineering 2, No. 10 (2014): 9.
Sabau et al.: "Design additive manufacturing and performance of heat exchanger jwith a novel flow-path architecture", Applied Thermal Engineering 180(2020) 115775.
Eliasson, Einar Tjörvi, Sverrir Thorhallsson, and Benedikt Steingrlmsson. "Geothermal power plants." Short Course on Geothermal Drilling, Resource Development and Power Plants, organized by the United Nations University-Geothermal Training Program and LaGeo, in Santa Tecla, El Salvador (2011).
X. Li, R. Le Pierres, S. Dewson, et al., "Heat exchangers for the next generation of nuclear reactors," Proceedings of the ICAPP, vol. 6, 2006, pp. 4-8.
T. Bello-Ochende, J.P. Meyer, J. Dirker, Three-dimensional multi-scale plate assembly for maximum heat transfer rate density, Int. J. Heat Mass Transfer 53 (2010) 586.
D. Amador, A. Gavriilidis, P. Angeli, Flow distribution in different microreactor scale-out geometries and the effect of manufacturing tolerances and channel blockage, Chem. Eng. J. 101 (2004) 379.
J. Fowler, G. A. Ledezma, A. Bejan, Optimal geometric arrangement of staggered plates in forced convection, Int. J. Heat Mass Transf. 40 (1997) 1795.
M. Ben Meftah, M. Mossa, Prediction of channel flow characteristics through square arrays of emergent cylinders, Phys. Fluids 25 (2013) 045102.
M. R. Salimpour, M. Sharifhasan, E. Shirani, Constructal optimization of the geometry of an array of micro-channels, Int. Commun. Heat Mass Transfer 38 (2011) 93.
L. A. O. Rocha, F. E. M. Saboya, J. V. C. Vargas, A comparative study of elliptical and circular sections in one- and two-row tubes and plate fin heat exchangers, Int. J. Heat Fluid Flow 18 (1997) 247.
M. I. Hasan, A. A. Rageb, M. Yaghoubi, H. Homayoni, Influence of channel geometry on the performance of a counter flow microchannel heat exchanger, Int. J Thermal Sciences 48 (2009) 1607.
A. Alfaryjat, H. A. Mohammed, N. M. Adam, M. K. A. Ariffin, M. I. Najafabadi, Influence of geometrical parameters of hexagonal, circular, and rhombus microchannel heat sinks on the thermohydraulic characteristics, Int. Commun. Heat Mass Transfer 52 (2014) 121.
H. A. Mohammed, P. Gunnasegaran, N. H. Shuaib, Influence of channel shape on the thermal and hydraulic performance of microchannel heat sink, Int. Commun. Heat Mass Transfer 38 (2011) 474.
T.C. Hung, T.S. Sheu, W.M. Yan, Optimal thermal design of microchannel heat sinks with different geometric configurations, Int. Commun. Heat Mass Transfer 39 (2012) 1572.
Y. Sui, C.J. Teo, P.S. Lee, Y.T. Chew, C. Shu, Fluid flow and heat transfer in wavy microchannels, Int. J. Heat Mass Transfer 53 (2010) 2760.
M. Dehghan, M. Daneshipour, M.S. Valipour, R. Rafee, S. Saedodin, Enhancing heat transfer in microchannel heat sinks using converging flow passages, Energy Convers Manag. 92 (2015) 244.
Bejan A., Almerbati A., Lorente A., Sabau A.S., and Klett J.W., Arrays of flow channels with heat transfer embedded in conducting walls, International Journal of Heat and Mass Transfer, vol. 99, pp. 504-511, 2016a.
Bejan A., Alalaimi M., Lorente A., Sabau A.S., and Klett J.W., Counterflow heat exchanger with core and plenums at both ends, International Journal of Heat and Mass Transfer, vol. 99, pp. 622-629, 2016b.
S.M. Thompson, Z.S. Aspin, N. Shamsaei, A. Elwany, L. Bian, "Additive Manufacturing, Additive manufacturing of heat axchangers: A case study on a multi-layered Ti-6Al-4V oscillating heat pipe," vol. 8, pp. 163-174, 2015.
Y. Rua, R. Muren and S. Reckinger, Limitations of Additive Manufacturing on Microfluidic Heat Exchanger Components, Journal of Manufacturing Science and Engineering-Transactions of the ASME, vol. 137, Article No. 034504, 2015.
Beyer C., "Strategic Implications of Current Trends in Additive Manufacturing," ASME. J. Manuf. Sci. Eng., vol. 136, Article No. 064701-064701-8, doi: 10.1115/1.4028599, 2014.
Heidrich, J. R., Gervasi, V., & Kumpaty, S. (n d.)., Synthesis of a compact tetralattice heat exchanger using solid freeform fabrication and comparison testing against a tube heat exchanger, Proceedings of 12th Solid Freeform Fabrication Symposium, 2001, Austin, Texas, pp. 567-575.
Lyons, A., S. Krishnan, J. Mullins, M. Hodes and D. Hernon, 2009, "Advanced Heat Sinks Enabled by Three-Dimensional Printing," International Solid Freeform Fabrication Symposium, Austin, TX.
Hattiangadi, A. and Bandyopadhyay, A., 1999, "Processing, Characterization and Modeling of Non-Random Porous Ceramic Structures," International Solid Freeform Fabrication Symposium, Austin, TX, pp. 319-326.
Meisel, N.A., Williams, C.B., and Druschitz, A. "Lightweight Metal Cellular Structures via Indirect 3d Printing," Proceedings of the International Solid Freeform Fabrication Symposium, pp. 162-176, 2012.
M.A. Arie, A.H. Shooshtari, R. Tiwari, S.V. Dessiatoun, M.M. Ohadi, J.M. Pearce, "Experimental Characterization of Heat Transfer in an Additively Manufactured Polymer Heat Exchanger," Applied Thermal Engineering, vol. 113, pp. 575-584, 2017.
Žukauskas, Algirdas, Ulinskas, R. Banks of plain and finned tubes, Hemisphere handbook of heat exchanger design. Hemisphere, 1990.
Frazier, W.E., Metal Additive Manufacturing: A Review, J. of Materi Eng and Perform (2014) 23: 1917. https://doi.org/10.1007/s11665-014-0958-z.

* cited by examiner

MULTI-ZONE SHELL AND TUBE HEAT EXCHANGER

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention is related to heat exchangers, and more particularly to shell and tube heat exchangers.

BACKGROUND OF THE INVENTION

Current heat exchanger designs involve structures of simple geometries, such as plates, sheets, and circular tubes as the main building blocks. This geometry limitation was mainly due to fabrication limitations. Recently new fabrication routes, such as additive manufacturing, in which intricate near net shaped parts are created by precise successive additions of material by fusion with laser and/or electron beams to form near net shaped parts without material removal, offers the opportunity of fabricating novel heat exchangers. Moreover, other hybrid manufacturing processes that involve additive manufacturing, which are referred to as additive manufacturing assisted fabrication, such as those for the fabrication of polymer patterns for the investment casting or lost wax casting have been used to fabricate complex heat exchanger designs. Thus, new heat exchanger designs have now an opportunity to be fabricated and further tested for their performance.

Recent studies have focused on optimizing heat exchanger flow architecture in order to enhance the heat transfer rate. The longitudinal configuration of the flow channel such as zigzag, curvy, step, single-layer, double-layer, tapered, wavy and converging channels for the same cross-sectional shape has been investigated and compared with the conventional straight channel with uniform cross-sectional shape. Several studies have been conducted to study the effect of the non-circular wetted perimeter shape only on fluid flow performance. The channels in printed circuit heat exchangers (PCHE) for supercritical $CO_2$ Brayton cycle systems are semi-circular shape. The PCHE geometries involve very thick walls with very small effective areas open to flow, increasing the material cost. In summary, although the shape of the channel cross-section plays an important role in the performance of heat exchangers, alternative channel shapes to the circular ones is shell-and-tube like heat exchangers have not been used in industry due to fabrication difficulties or increase costs.

A counterflow heat exchanger is described in "Counterflow heat exchanger with core and plenums at both ends", A. Bejan et al, International Journal of Heat and Mass Transfer 99 (2016) 622-629. The disclosure of this reference is incorporated fully by reference. There is a continuing need to improve the performance of such heat exchangers, and to provide designs which facilitate fabrication by such methods as additive manufacturing.

SUMMARY OF THE INVENTION

A shell and tube heat exchanger includes an elongated shell having first and second opposing ends and an open interior. A core divides the open interior of the shell into first and second enclosed portions. A first tube fluid opening can be at the first end of the elongated shell, and a second tube fluid opening can be at the second end of the elongated shell.

An end plate (or tube sheet) in the first enclosed portion is provided between the first tube fluid opening and the core, and divides the first enclosed portion into a first manifold portion and a first enclosed shell chamber. A second end plate is provided in the second end portion between the second tube fluid opening and the core, and divides the second enclosed portion into a second manifold portion and a second enclosed shell chamber.

A first plurality of tubes extend from the first end plate, through the first enclosed shell chamber to the core. The first plurality of tubes have open ends communicating with the first manifold portion and open ends communicating with the second enclosed shell chamber. A second plurality of tubes extend from the second end plate, through the second enclosed shell chamber to the core. The second plurality of tubes have open ends communicating with the second manifold portion and open ends communicating with the first enclosed shell chamber.

Shell fluid openings are provided at sides of the elongated shell. A first shell fluid opening communicates with the first enclosed shell chamber. A second shell fluid opening communicates with the second enclosed shell chamber.

The elongated shell has a long axis, and the end plates can be angled relative to the long axis. The angle can be from 15-75°. The core can be angled at the same angle as the end plates.

The tubes can be polygonal with rounded corners and straight sides. The rounded corners can have a radius r and a length L, and the ratio of r/L is less than 1.45. The ratio of r/L can be from 0.05-0.55. The polygonal tubes can be triangular shaped. The polygonal tubes can be diamond-shaped. The polygonal tubes can be square shaped. The tubes can have circular cross section.

The first enclosed shell chamber can have a volume greater than the volume of the second enclosed shell chamber, and the first plurality of tubes can be longer than the second plurality of tubes. In one embodiment, the first tube fluid opening can receive high temperature fluid, the second tube fluid opening can receive low temperature fluid, the first shell fluid opening can exhaust low temperature fluid, and the second shell fluid opening can exhaust high temperature fluid. In another embodiment, the first tube fluid opening exhausts low temperature fluid, the second tube fluid opening exhausts high temperature fluid, the first shell fluid opening receives high temperature fluid, and the second shell fluid opening receives low temperature fluid. In another embodiment, the first tube fluid opening receives low temperature fluid, the second tube fluid opening receives high temperature fluid, the first shell fluid opening exhausts high temperature fluid and the second shell fluid opening exhausts low temperature flow. In another embodiment, the first tube fluid opening exhausts high temperature fluid, the second tube fluid opening exhausts low temperature fluid, the first shell fluid opening receives low temperature fluid, and the second shell fluid opening receives high temperature fluid.

The core can have a length that is from 5%-75% of the length of the elongated shell. The core can have a minimum length that of 3 mm. The minimum core length can be the minimum of 3 mm or 5% of the length of the elongated shell. The maximum core length can be 75% of the length of the elongated shell.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
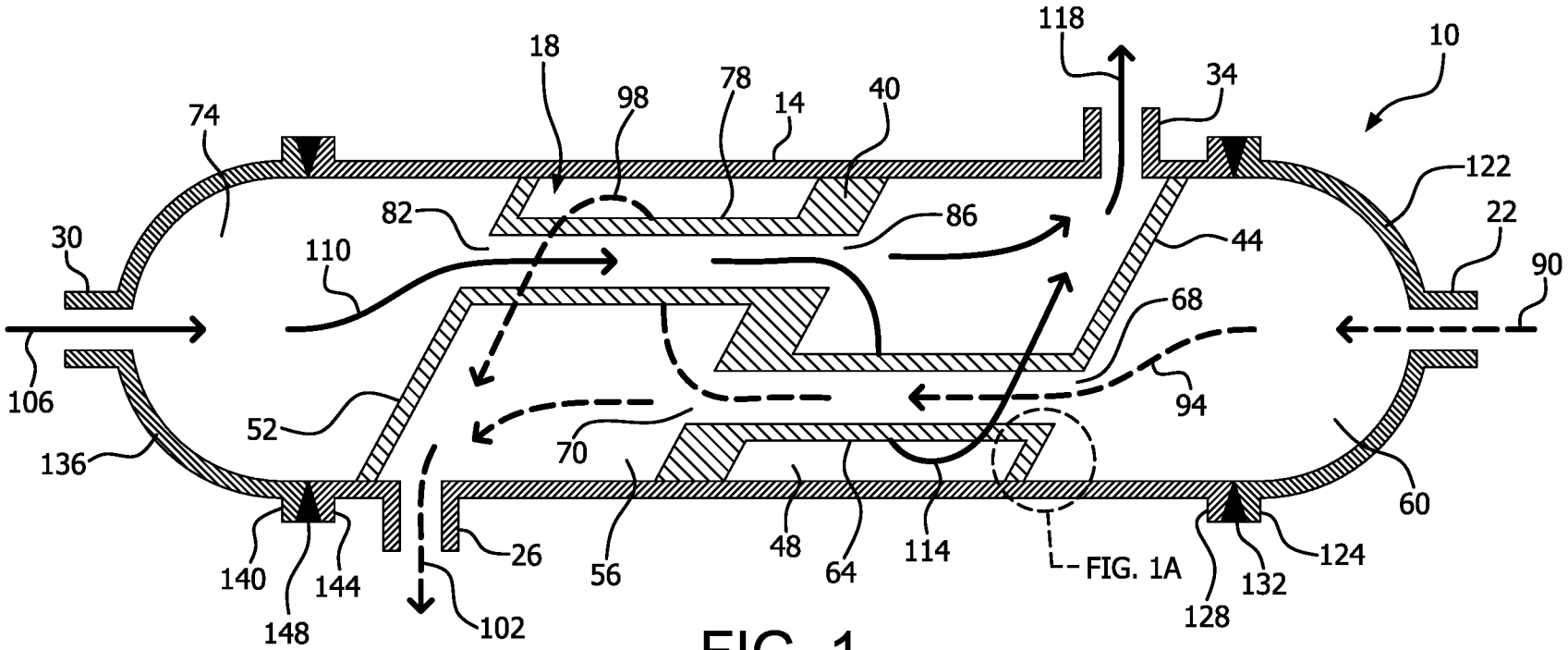
FIG. 1 is a schematic cross-section of a shell and tube heat exchanger according to the invention.

A shell and tube heat exchanger includes an elongated shell having first and second opposing ends and an open interior. A core divides the open interior of the shell into first and second enclosed portions. A first tube fluid opening can be at the first end of the elongated shell, and a second tube fluid opening can be at the second end of the elongated shell. An end plate (or tube sheet) in the first enclosed portion core is provided between the first tube fluid opening and the core, and divides the first enclosed portion into a first manifold portion and a first enclosed shell chamber. A second end plate is provided in the second end portion between the second tube fluid opening and the core, and divides the second enclosed portion into a second manifold portion and a second enclosed shell chamber.

A first plurality of tubes extend from the first end plate, through the first enclosed shell chamber to the core. The first plurality of tubes have open ends communicating with the first manifold portion and open ends communicating with the second enclosed shell chamber. A second plurality of tubes extend from the second end plate, through the second enclosed shell chamber to the core. The second plurality of tubes have open ends communicating with the second manifold portion and open ends communicating with the first enclosed shell chamber. Shell fluid openings are provided at sides of the elongated shell. A first shell fluid opening communicates with the first enclosed shell chamber. A second shell fluid opening communicates with the second enclosed shell chamber.

Any number of tube fluid openings and shell fluid openings are possible. The description that follows refers to a minimum number of tube fluid openings, shell fluid openings, and tubes for ease of depiction and description, and to facilitate an understanding of the invention. In practice, however multiple tubes are commonly used in shell and tube heat exchangers. Further, although the following describes a single heat exchanger in operation, multiple heat exchangers can be used and connected in series and/or in parallel depending upon the intended use. See, for example, "Design, additive manufacturing, and performance of heat exchanger with a novel flow path architecture", A. Sabau et al, Applied Thermal Engineering 180 (2020) 115775, the disclosure of which is incorporated fully by reference.

The elongated shell has a long axis, and the end plates can be angled relative to the long axis. The angle can be denoted as a and can be from 15-75°. The core can be angled at the same angle as the end plates. The angle $\alpha$ can be 15°, 20°, 25°, 30°, 35°, 40°, 45°, 50°, 55°, 60°, 65°, 70°, and 75°, and can be within a range of any high value and low value selected from these values.

The tubes can be polygonal with rounded corners and straight sides. Sharp corners result in stagnant fluid flow in the vertex regions, and heat transfer would be poor. The invention eliminates such stagnation by providing corners which do not result stagnant fluid flow regions. The rounded corners can have a radius r and a length L, and the ratio of r/L is less than 1.45. The ratio of r/L can be from 0.05-0.55. The ratio of r/L can be 0.05, 0.1, 0.15, 0.2, 0.25, 0.3, 0.35, 0.4, 0.45, 0.5, and 0.55, and can be within a range of any high value and low value selected from these values. The polygonal tubes can be triangular shaped. The polygonal tubes can be diamond-shaped. The polygonal tubes can be square shaped. The tubes can have circular cross section.

The first enclosed shell chamber can have a volume greater than the volume of the second enclosed shell chamber, and the first plurality of tubes can be longer than the second plurality of tubes. This permits a great variety of permutations and arrangements, for example in evaporation and condensation processes, where the enclosed shell chamber can be larger to accommodate the larger volume of the gas. In one embodiment, the first tube fluid opening can receive high temperature fluid, the second tube fluid opening can receive low temperature fluid, the first shell fluid opening can exhaust low temperature fluid, and the second shell fluid opening can exhaust high temperature fluid. In another embodiment, the first tube fluid opening exhausts low temperature fluid, the second tube fluid opening exhausts high temperature fluid, the first shell fluid opening receives high temperature fluid, and the second shell fluid opening receives low temperature fluid. In another embodiment, the first tube fluid opening receives low temperature fluid, the second tube fluid opening receives high temperature fluid, the first shell fluid opening exhausts high temperature fluid and the second shell fluid opening exhausts low temperature flow. In another embodiment, the first tube fluid opening exhausts high temperature fluid, the second tube fluid opening exhausts low temperature fluid, the first shell fluid opening receives low temperature fluid, and the second shell fluid opening receives high temperature fluid.

The dimensions of the core can also be changed to optimize a particular heat exchange requirement. The core can have a length that is from 5%-75% of the length of the elongated shell. The core can have a length that is 5, 10, 15, 20, 25, 30, 35, 40, 45, 50, 55, 60, 65, 70, or 75% of the length of the elongated shell, and can be within a range of any high value and low value selected from these values. Particularly for long heat exchangers some of the desirable configurations will have a very thin core. The core can have a minimum length that of 3 mm. The minimum core length can be the minimum of 3 mm or 5% of the length of the elongated shell. The maximum core length can be 75% of the length of the elongated shell.

Figure 2:
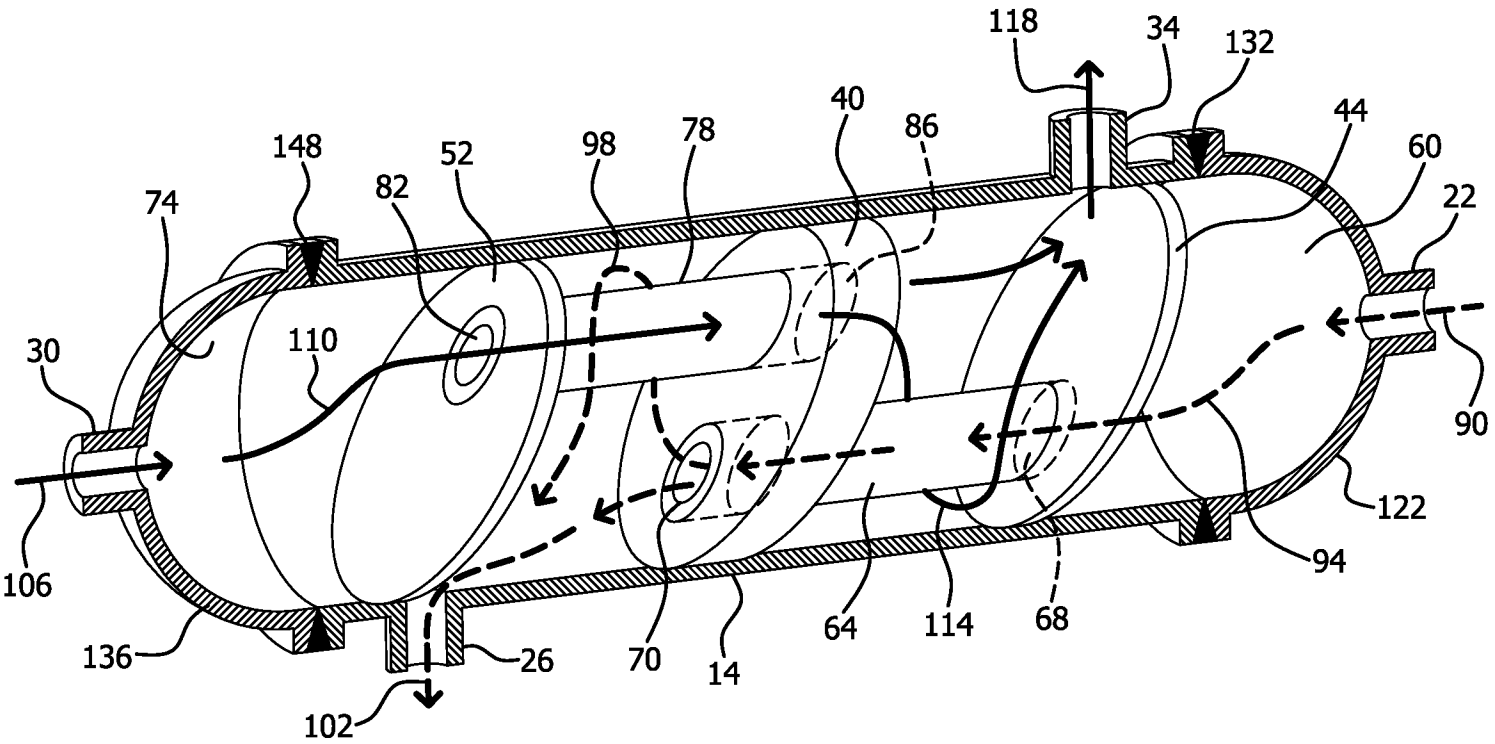
FIG. 2 is a schematic perspective view of the heat exchanger of FIG. 1.

There is shown in FIGS. 1-2 a shell and tube heat exchanger 10 according to the invention. The heat exchanger 10 has an elongated shell 14 defining an open interior 18. Tube fluid openings 22 and 30 can be provided at opposing ends of the elongated shell 14. Shell fluid openings 26 and 34 can be provided at opposing side portions of the elongated shell 14. A core 40 is positioned within the elongated shell 14 and divides the interior 18 into first and second enclosed shell portions. An end plate 44 further divides a first of the enclosed shell portions into a first enclosed shell chamber 48 and a first manifold chamber 60. An end plate 52 further divides a second of the enclosed shell portions into a second enclosed shell chamber 56 and a second manifold chamber 74.

A first plurality of tubes 64 extend from the first end plate, through the first enclosed shell chamber 48 to the core 40. The tubes 64 have open ends 68 communicating with the first manifold portion and open ends 70 communicating with the second enclosed shell chamber 56. A second plurality of tubes 78 extend from the second end plate 52, through the second enclosed shell chamber 56 to the core 40. The second tubes 78 have open ends 82 communicating with the second manifold portion 74 and open ends 86 communicating with the first enclosed shell chamber 48. A single first tube 64 and second tube 78 are shown for ease of depiction and understanding, however, in practice multiple such tubes would be used. The number of tubes will depend on the design of the particular heat exchanger.

Figure 1A:
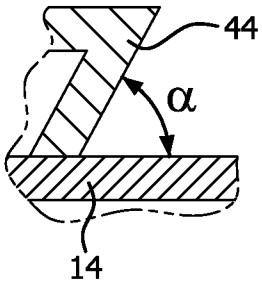
FIG. 1A is an expanded view of area FIG. 1A in FIG. 1.

FIG. 1A is an expanded view of area FIG. 1A in FIG. 1. FIG. 1A shows included angle $\alpha$. The end plate 44, and plate 52, and core 40 can all the angled with respect to the elongated shell 14. This facilitates construction by additive manufacturing particularly in a build direction that is along the long axis of the elongated shell 14. Proper positioning of the shell fluid openings 26 and 34 adjacent to one of the angled end plates 44 and 52 also serves the purpose of funneling fluid flow to and from the shell fluid openings 26 and 34.

Fluid enters the tube fluid opening 22 as shown by arrow 90, and as shown by arrow 94 enters the opening 68 of the tube 64. The fluid then leaves the opening 70 of the tube 64 whereupon the fluid circulates within the second enclosed shell chamber 56 and exchanges heat with the tube 78 as shown by the arrow 98. The fluid is exhausted through the shell fluid opening 26 as shown by arrow 102. Fluid also enters the tube fluid opening 30 as shown by arrow 106 and enters the tube 78 through the opening 82 as shown by the arrow 110. The fluid leaves opening 86 of the tube 78 and circulates within the enclosed shell chamber 48 and exchanges heat with the tube 64 as shown by the arrow 114. Fluid leaves the shell chamber 48 through the shell to fluid opening 34 as shown by arrow 118.

The heat exchanger 10 can be made by any suitable process. The angled end plates 44 and 52 and core 40 make the heat exchanger 10 particularly well-suited for additive manufacturing. A first manifold cover 122 and second manifold cover 136 can be provided. The first manifold cover 122 can be secured by suitable structure such as flanges 124 and 128 adhered by a weld 132. The second manifold cover 136 can be secured by flanges 140 and 144 adhered by weld 148. Other constructions are possible.

Figure 3:
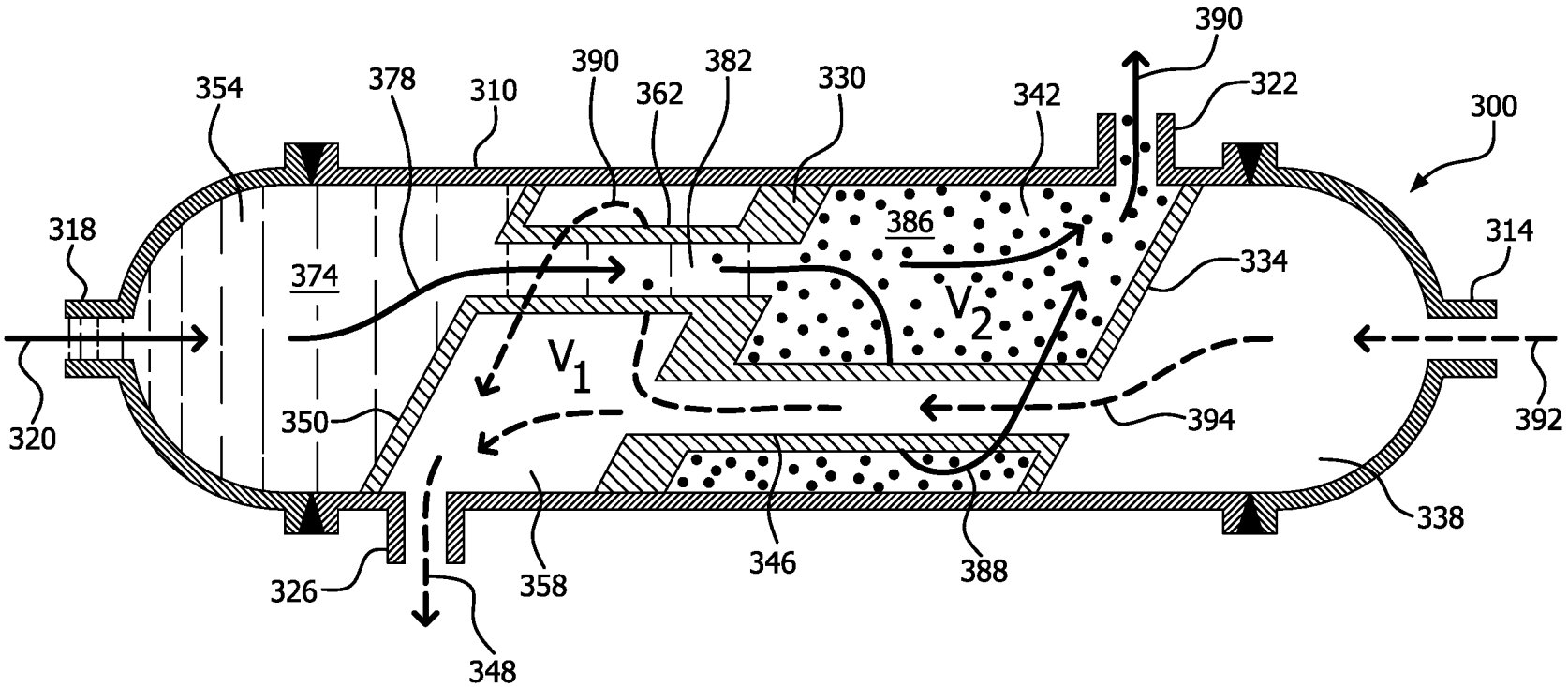
FIG. 3 is a schematic cross-section of a heat exchanger according to the invention in an evaporation mode of operation.

FIG. 3 is a schematic cross-section of a heat exchanger 300 in an evaporation mode of operation. The heat exchanger 300 has an elongated shell 310 with tube fluid openings 314 and 318 and shell fluid openings 322 and 326. A core 330 divides the open interior of the elongated shell 310. An end plate 334 forms a manifold portion 338 and an enclosed shell chamber 342. A tube 346 extends through the shell chamber 342. An end plate 350 forms a manifold portion 354 and enclosed shell chamber 358. A tube 362 extends through the shell chamber 358. Liquid enters the tube fluid opening 318 as shown by arrow 320 and accumulates in the manifold space 354 as liquid 374 (broken lines). The liquid 374 enters the tube 362 as shown by arrow 378. Within the open interior 382 of the tube 362 the liquid takes on heat and evaporates into the gas 386 (dots) which enters the enclosed chamber 342 and circulates around the tube 346 as shown by arrow 388. The gas exits through the shell fluid opening 322 as shown by arrow 390. A heat exchange fluid which can be a liquid or gas enters the tube fluid opening 314 as shown by arrow 392, flows into the tube 346 as shown by arrow 394, and circulates in the enclosed chamber 358 around the tube 362 as shown by arrow 390. The heat exchange fluid thereby exchanges heat with the tube 362 and the liquid 374 flowing through the open interior 382 of the tube 362. The heat exchange fluid exits the heat exchanger 300 through the shell fluid opening 326 as shown by arrow 348.

Figure 4:
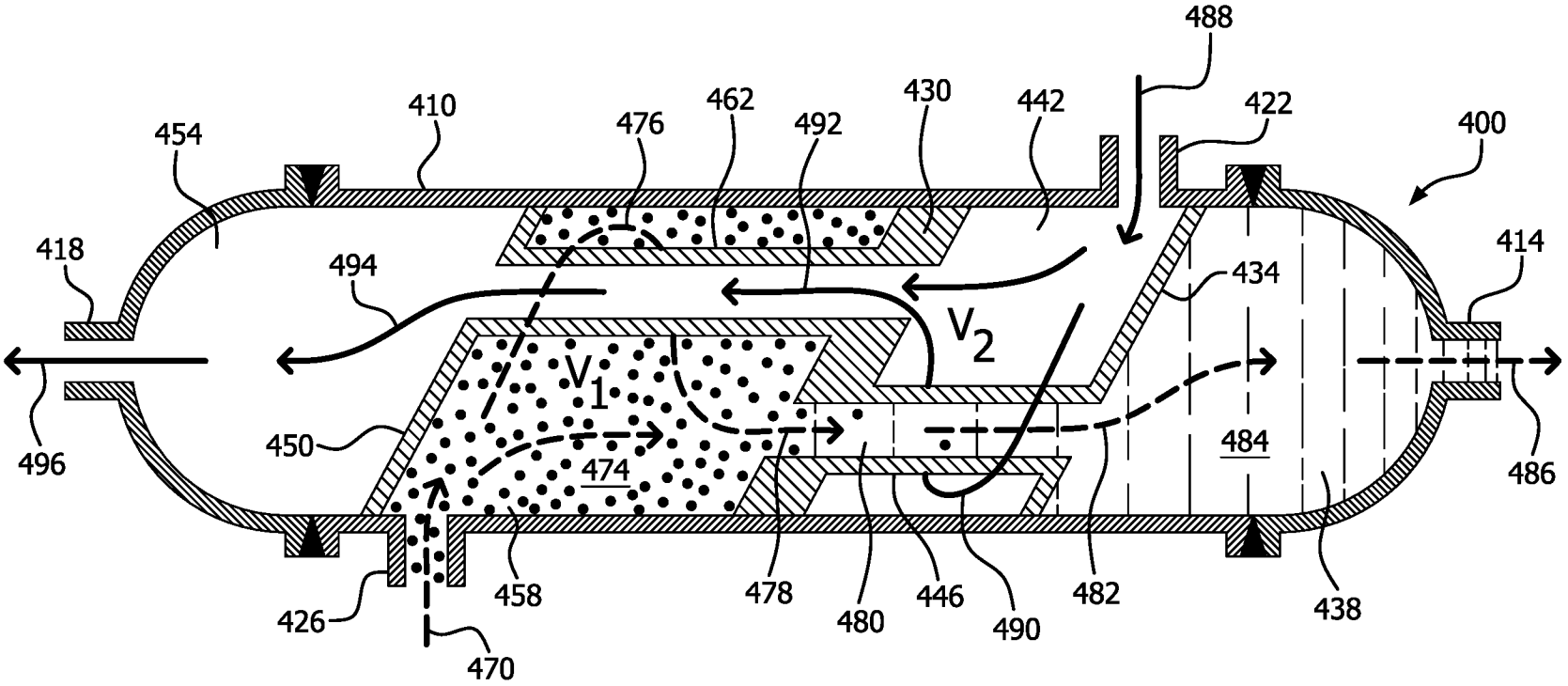
FIG. 4 is a schematic cross-section of a heat exchanger according to the invention in a condensation mode of operation.

FIG. 4 is a schematic cross-section of a heat exchanger 400 in a condensation mode of operation. The heat exchanger 400 has an elongated shell 410 with tube fluid openings 414 and 418 and shell fluid openings 422 and 426. A core 430 divides the open interior of the elongated shell 410. An end plate 434 forms a manifold portion 438 and an enclosed shell chamber 442. A tube 446 extends through the shell chamber 442. An end plate 450 forms a manifold portion 454 and enclosed shell chamber 458. A tube 462 extends through the shell chamber 458. Gas enters the shell fluid opening 426 as shown by arrow 470 and accumulates in the enclosed shell chamber 458 as gas 474 (dots). The gas 474 circulates around the tube 462 as shown by arrow 476 and enters the interior 480 of the tube 446 as shown by arrow 478. The gas condenses within the tube 446 as indicated by the transition from dots depicting gas to broken lines depicting liquid and exits the tube 446 as liquid 484 as shown by arrow 482. The liquid exits the tube fluid opening 414 as indicated by arrow 486. A heat exchange fluid which can be liquid or gas enters the shell fluid opening 422 is shown by arrow 488. The heat exchange fluid circulates around and exchanges heat with the tube 446 as shown by arrow 490 and enters the tube 462 as shown by arrow 492. The heat exchange fluid exits the tube 462 as shown by arrow 494 and exits the heat exchanger 400 through the tube fluid opening 418 as shown by arrow 496.

Figure 5:
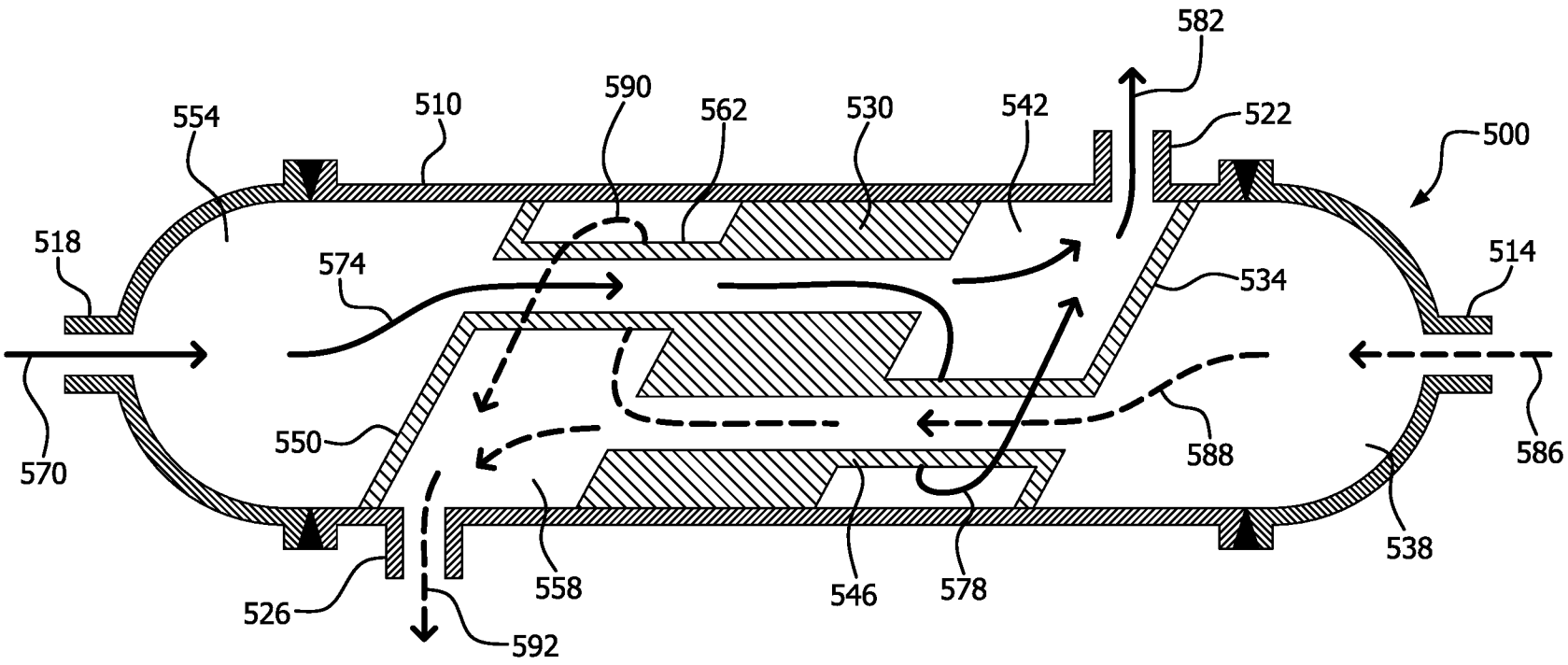
FIG. 5 is a schematic cross-section of a heat exchanger according to the invention with an expanded core.

FIG. 5 is a schematic cross-section of a heat exchanger according to the invention with an expanded core. The heat exchanger 500 has an elongated shell 510 with tube fluid openings 514 and 518 and shell fluid openings 522 and 526. A core 530 divides the open interior of the elongated shell 510. An end plate 534 forms a manifold portion 538 and an enclosed shell chamber 542. A tube 546 extends through the shell chamber 542. An end plate 550 forms a manifold portion 554 and enclosed shell chamber 558. A tube 562 extends through the shell chamber 558. Fluid enters the tube fluid opening 518 as shown by arrow 570 and enters the tube 562 as shown by arrow 574 and exchanges heat while in the tube 562. The core 530 in this embodiment is expanded in length, and as shown can be as long or longer than the tubes 546 and 562. The fluid enters the enclosed chamber 542 and circulates around the tube 546 as shown by arrow 578. The fluid exits through the shell fluid opening 522 as shown by arrow 582. Another fluid for heat exchange which can be a liquid or gas enters the tube fluid opening 514 as shown by arrow 586, flows into the tube 546 as shown by arrow 588, and circulates in the enclosed chamber 558 around the tube 562 as shown by arrow 590. The second heat exchange fluid thereby exchanges heat with the tube 562 and the fluid flowing through the tube 562. The heat exchange fluid exits the heat exchanger 500 through the shell fluid opening 526 as shown by arrow 592.

Figure 6:
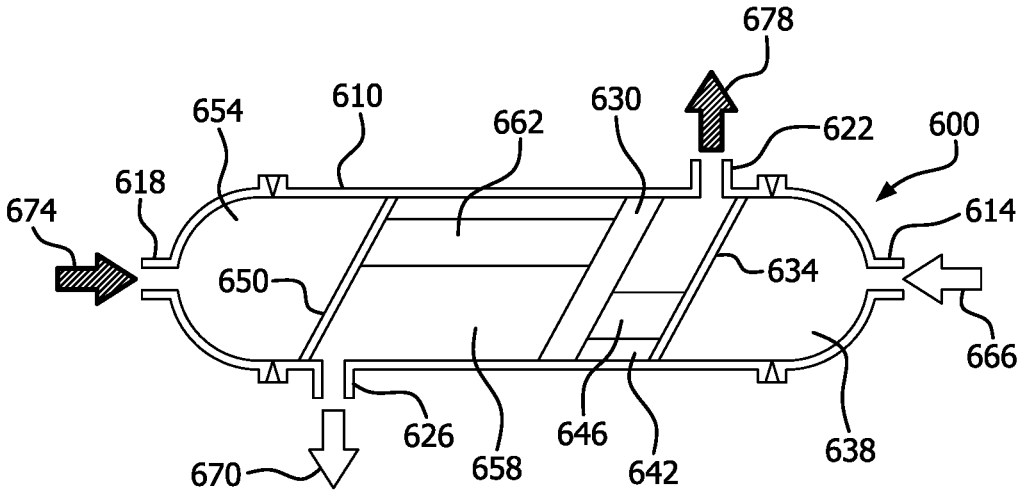
FIG. 6 is a schematic cross-section of a heat exchanger according to the invention in a first mode of operation.

A feature of the invention is that the tubes on either side of the core can have different lengths for different heat transfer operations. FIGS. 6-9 depict a heat exchanger according to the invention with long and short tubes, working with hot and cold (relative) fluids (liquid or gas). In FIG. 6, a heat exchanger 600 has an elongated shell 610 with tube fluid openings 614 and 618 and shell fluid openings 622 and 626. A core 630 divides the open interior of the elongated shell 610. An end plate 634 forms a manifold portion 638 and an enclosed shell chamber 642. A shorter tube 646 extends through the shell chamber 642. An end plate 650 forms a manifold portion 654 and enclosed shell chamber 658. A longer tube 662 extends through the shell chamber 658.

Hot fluid enters the tube fluid opening 618 as shown by arrow 674 and enters the tube 662 and exchanges heat while in the longer tube 662. The hot fluid enters the enclosed chamber 642 and circulates around the shorter tube 646, and exits through the shell fluid opening 622 as shown by arrow 678. A cold fluid enters the tube fluid opening 614 as shown by arrow 666, flows into the shorter tube 646 and circulates in the enclosed chamber 658 around the longer tube 662. The cold fluid thereby exchanges heat with the longer tube 662 and the hot fluid flowing through the longer tube 662. The cold fluid exits the heat exchanger 600 through the shell fluid opening 626 as shown by arrow 670.

Figure 7:
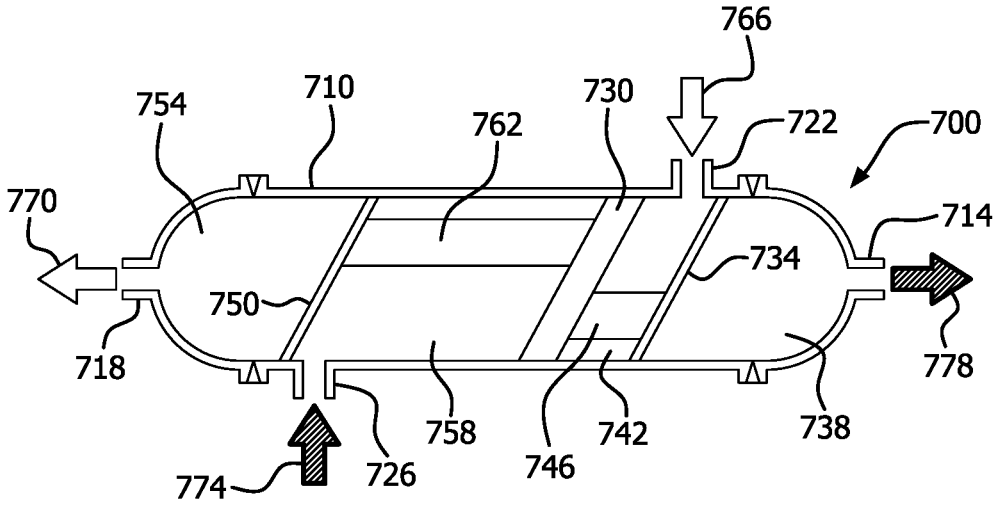
FIG. 7 is a schematic cross-section of a heat exchanger according to the invention in a second mode of operation.

A second mode of operation is shown in FIG. 7. A heat exchanger 700 has an elongated shell 710 with tube fluid openings 714 and 718 and shell fluid openings 722 and 726. A core 730 divides the open interior of the elongated shell 710. An end plate 734 forms a manifold portion 738 and an enclosed shell chamber 742. A shorter tube 746 extends through the shell chamber 742. An end plate 750 forms a manifold portion 754 and enclosed shell chamber 758. A longer tube 762 extends through the shell chamber 758.

Hot fluid enters through the shell fluid opening 726 as shown by arrow 774. The hot fluid flows around and exchanges heat with the longer tube 762 and then enters the shorter tube 746 and exits through the tube fluid opening 714 as shown by arrow 778. Cold fluid enters through the shell fluid opening 722 as shown by arrow 766. The cold fluid flows around and exchanges heat with the shorter tube 746 and enters the longer tube 762 and exits through the tube fluid opening 718 as shown by arrow 770.

Figure 8:
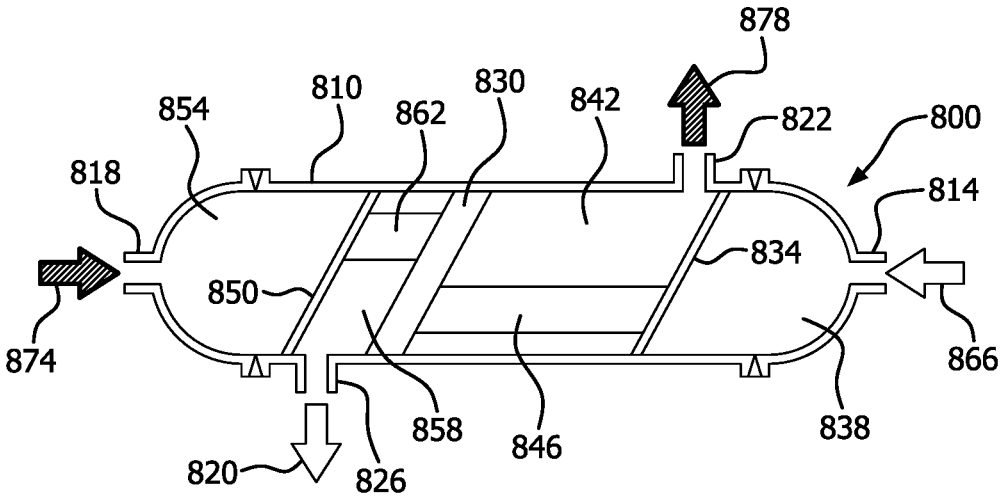
FIG. 8 is a schematic cross-section of a heat exchanger according to the invention in a third of operation.

A third mode of operation is shown in FIG. 8. A heat exchanger 800 has an elongated shell 810 with tube fluid openings 814 and 818 and shell fluid openings 822 and 826. A core 830 divides the open interior of the elongated shell 810. An end plate 834 forms a manifold portion 838 and an enclosed shell chamber 842. A longer tube 846 extends through the shell chamber 842. An end plate 850 forms a manifold portion 854 and enclosed shell chamber 858. A shorter tube 862 extends through the shell chamber 858.

Hot fluid enters the tube fluid opening 818 as shown by arrow 874 and enters the shorter tube 862 and exchanges heat while in the shorter tube 862. The hot fluid enters the enclosed chamber 842 and circulates around the longer tube 846, and exits through the shell fluid opening 822 as shown by arrow 878. A cold fluid enters the tube fluid opening 814 as shown by arrow 866, flows into the longer tube 846 and circulates in the enclosed chamber 858 around the shorter tube 862. The cold fluid thereby exchanges heat with the shorter tube 862 and the hot fluid flowing through the shorter tube 862. The cold fluid exits the heat exchanger 800 through the shell fluid opening 826 as shown by arrow 820.

Figure 9:
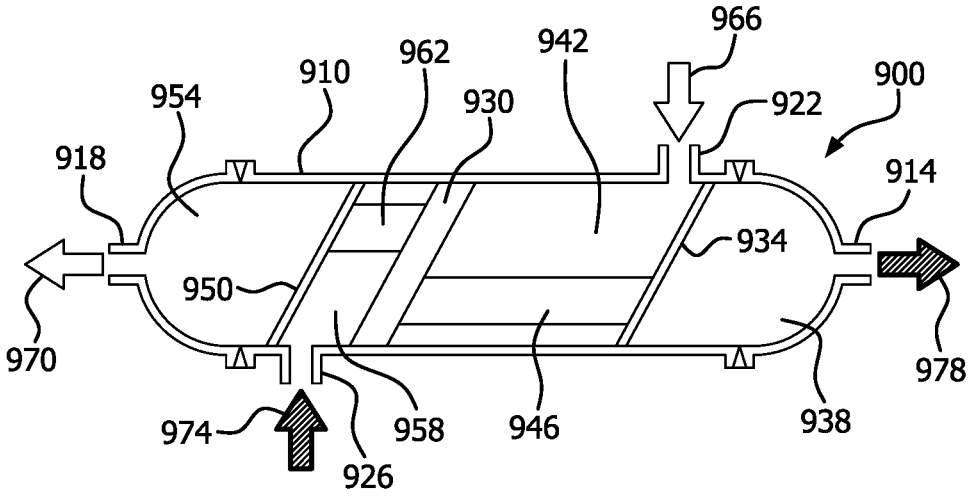
FIG. 9 is a schematic cross-section of a heat exchanger according invention in a fourth mode of operation.

A fourth mode of operation is shown in FIG. 9. A heat exchanger 900 has an elongated shell 910 with tube fluid openings 914 and 918 and shell fluid openings 922 and 926. A core 930 divides the open interior of the elongated shell 910. An end plate 934 forms a manifold portion 938 and an enclosed shell chamber 942. A longer tube 946 extends through the shell chamber 942. An end plate 950 forms a manifold portion 954 and enclosed shell chamber 958. A shorter tube 962 extends through the shell chamber 958.

Hot fluid enters through the shell fluid opening 926 as shown by arrow 974. The hot fluid flows around and exchanges heat with the shorter tube 962 and then enters the longer tube 946 and exits through the tube fluid opening 914 as shown by arrow 978. Cold fluid enters through the shell fluid opening 922 as shown by arrow 966. The cold fluid flows around and exchanges heat with the longer tube 946 and enters the shorter tube 962 and exits through the tube fluid opening 918 as shown by arrow 970.

Figure 10:
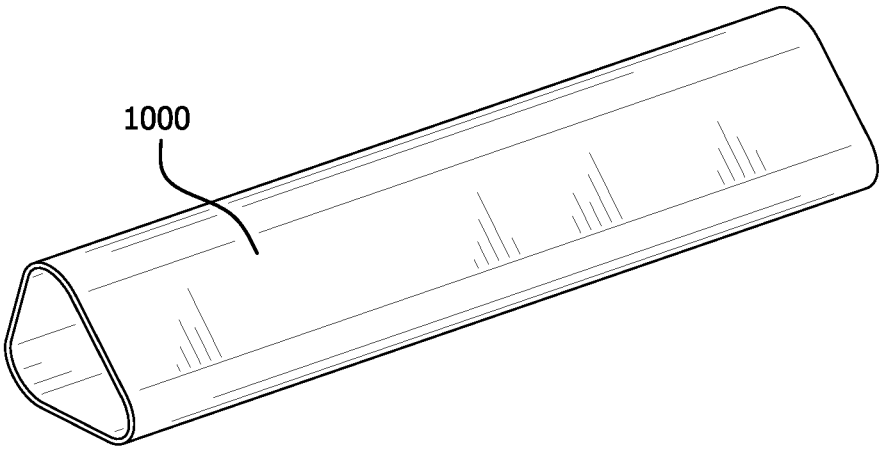
FIG. 10 is a perspective view of a triangular heat exchanger tube.
Figure 11:
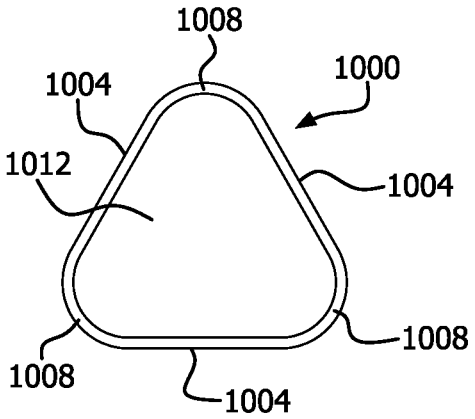
FIG. 11 is a cross sectional view of a triangular heat exchanger tube.
Figure 12:
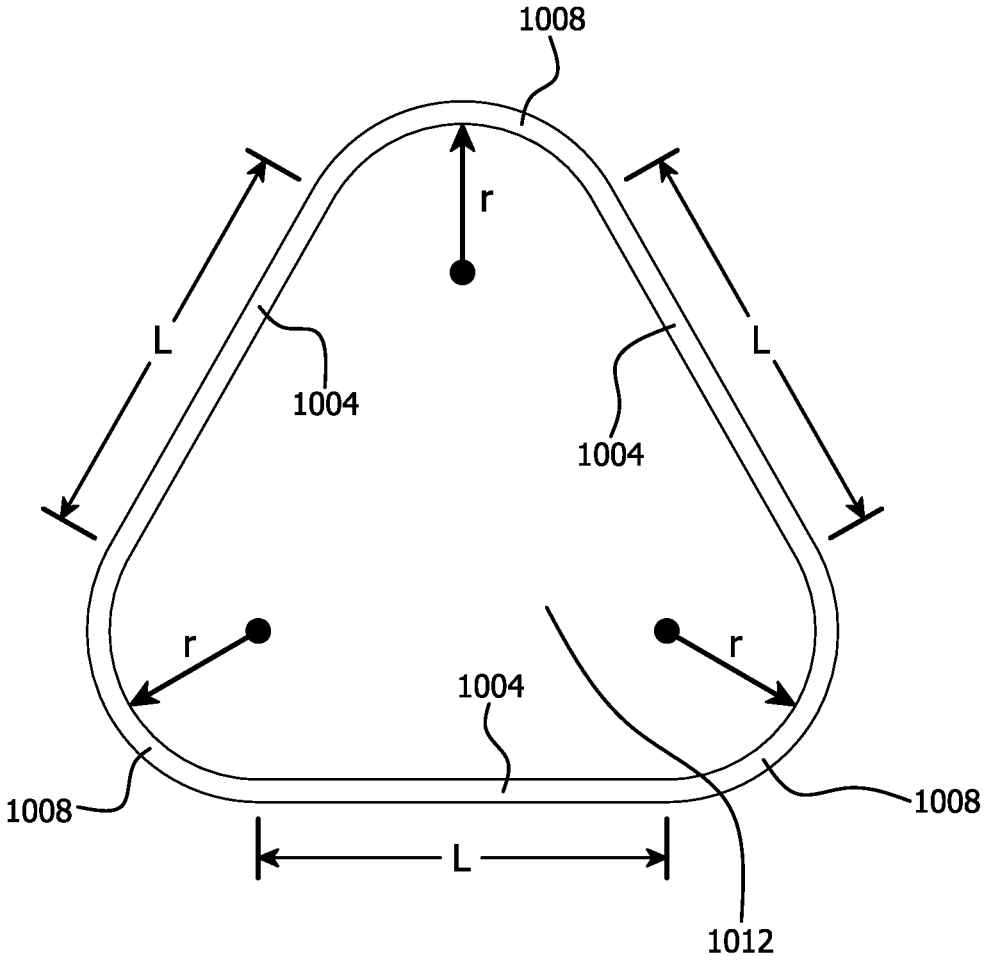
FIG. 12 is a cross-sectional view of a triangular heat exchanger tube of radius r and length L.

FIG. 10 is a perspective view of a triangular heat exchanger tube 1000. As shown in FIG. 11, the heat exchanger to has straight sides 1004 and rounded corners 1008 defining an open interior 1012. As shown in FIG. 12, the rounded corners 1008 have a radius r and the straight sides 1004 have a length L. As noted, the ratio of r/L should be less than 1.45.

Figure 13:
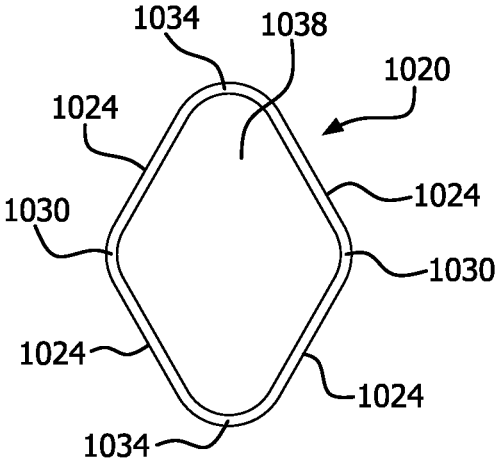
FIG. 13 is a cross-sectional view of a diamond-shaped heat exchanger tube.

FIG. 13 is a cross-sectional view of an alternative design with a diamond shaped heat exchanger tube 1020. The diamond-shaped heat exchanger tube 1020 has straight sides 1024 and major (larger r) rounded corners 1030 and minor (smaller r) rounded corners 1034. The diamond-shaped heat exchanger to 1020 is an open interior 1038.

Figure 14:
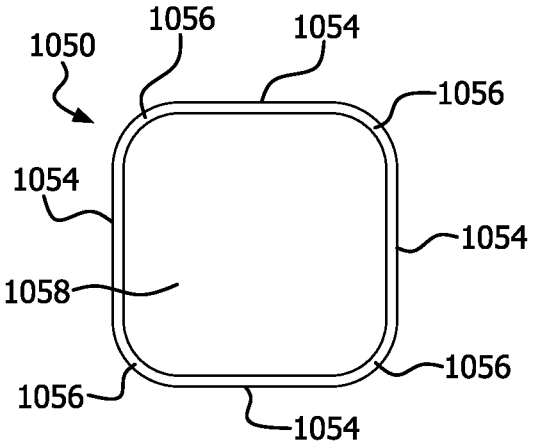
FIG. 14 is a cross-sectional view of a square-shaped heat exchanger tube.

FIG. 14 is a cross-sectional view of a square-shaped heat exchanger tube 1050. The square-shaped heat exchanger tube 1050 has straight sides 1054 and rounded corners 1056 defining an open interior 1058.

Figure 15:
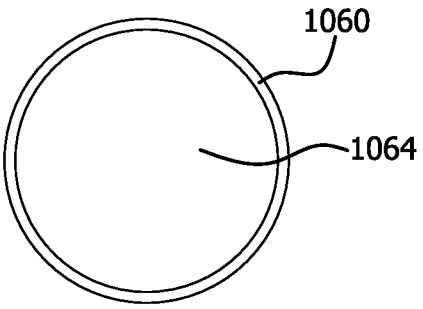
FIG. 15 is a cross-sectional view of a circular-shaped heat exchanger tube.

FIG. 15 is a cross-sectional view of a circular-shaped heat exchanger tube 1060 with an open interior 1064. The invention can be used with such traditional circular-shaped heat exchanger tubes. The diameter of the circular tube can vary.

Figure 16:
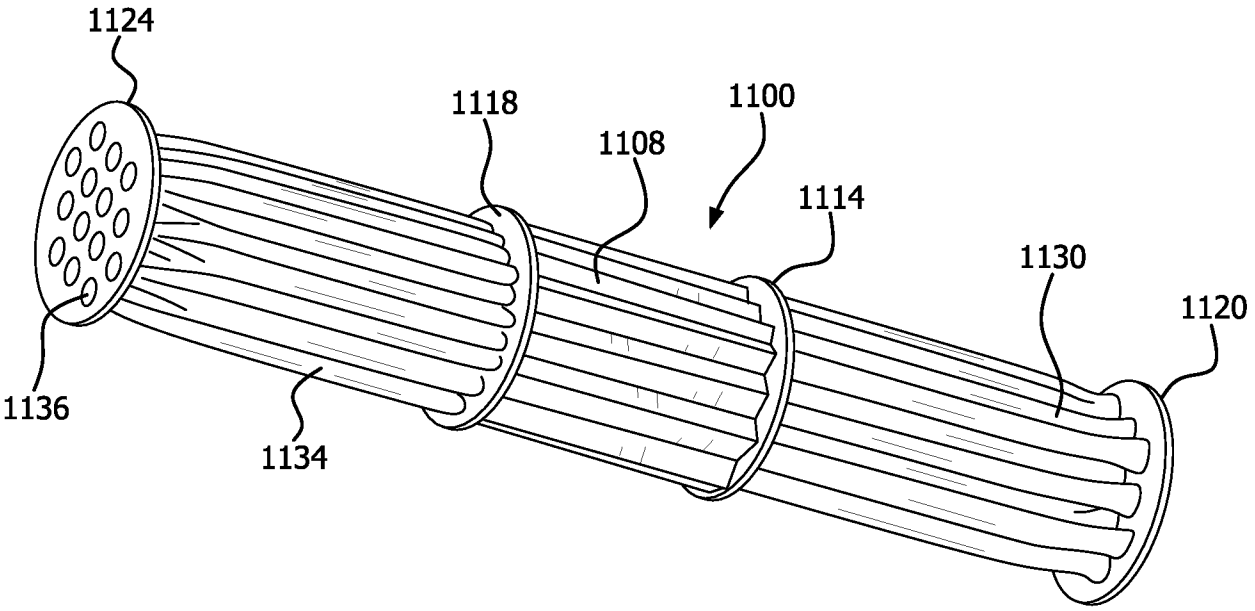
FIG. 16 is a perspective view of a heat exchanger according to the invention, with the elongated shell removed to reveal internal features.

FIG. 16 is a perspective view of a heat exchanger 1100 according to the invention, with the elongated shell removed to reveal internal features. The heat exchanger 1100 has a wide core 1108 with sides 1114 and 1118. A first plurality of heat exchanger tubes 1130 is connected between the core 1108 and an end plate 1120. A second plurality of heat exchanger tubes 1134 is connected between the core 1108 and an end plate 1124. The heat exchanger tubes 1134 have open interiors 1136.

Figure 17:
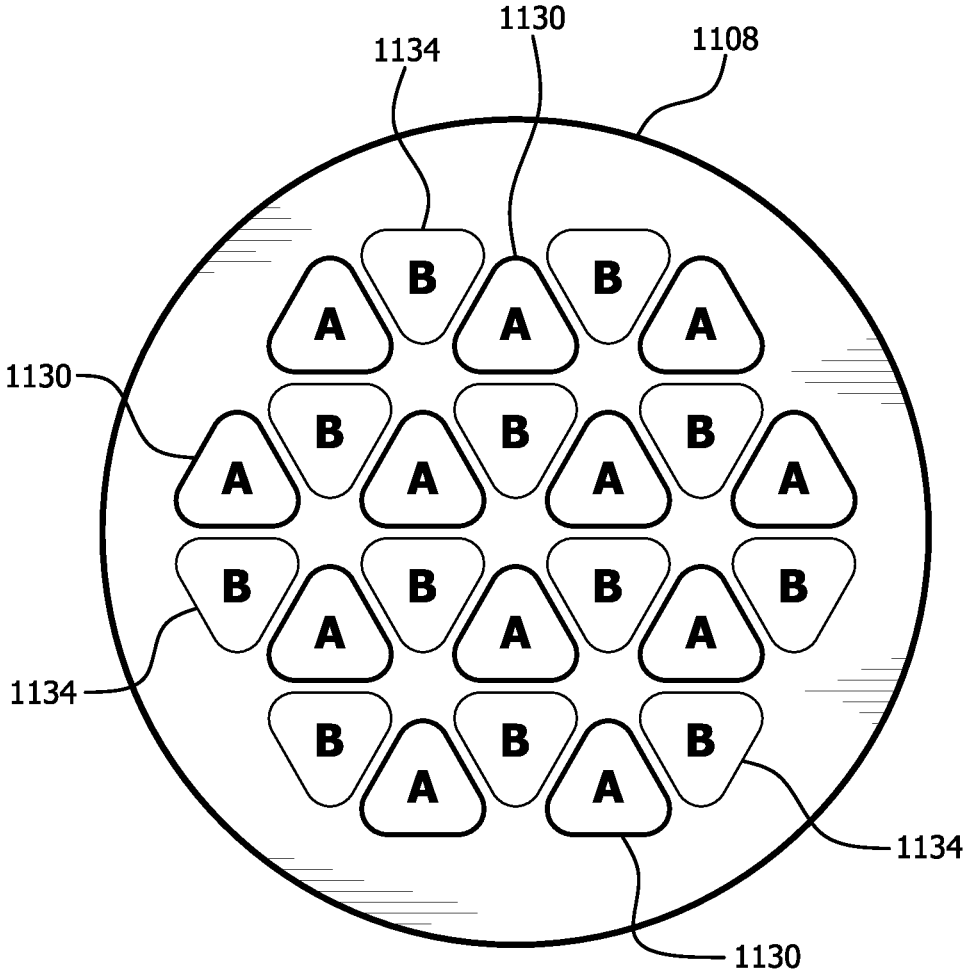
FIG. 17 is a schematic diagram illustrating flow through the core of a heat exchanger according to the invention.

FIG. 17 is a schematic diagram illustrating flow through the core 1108 of the heat exchanger 1100 the first plurality of heat exchanger tubes 1130 and the second plurality of heat exchanger tubes 1134 are juxtaposed within the core 1108. The flow through the heat exchanger tubes is opposite. For example, the flow in the heat exchanger tubes 1130 can be out of the page as indicated by the demarcation "A", while the flow in the heat exchanger tubes 1134 can be into the page as indicated by the demarcation "B".

Figure 18:
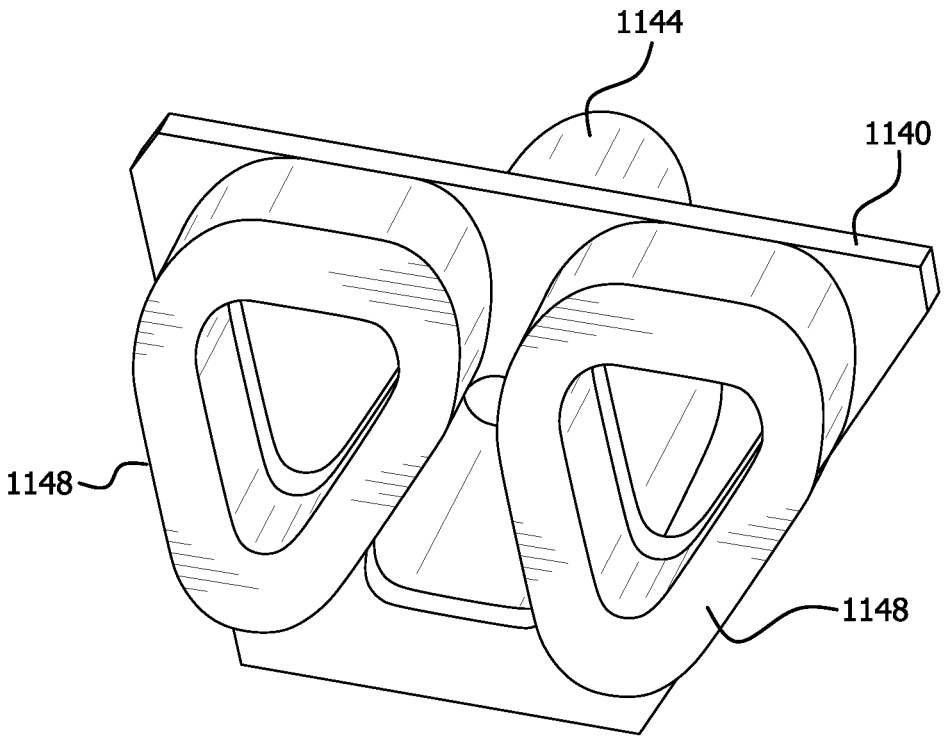
FIG. 18 is a perspective view of a portion of a core with triangular tubes.

FIG. 18 is a perspective view of a portion of a core 1140 with portions of triangular tubes 1144 carrying fluid in a first direction, for example out of the page, and heat exchanger tubes 1148 carrying fluid in a second direction, for example into the page. This construction can be readily fashioned by additive manufacturing.

Figure 19:
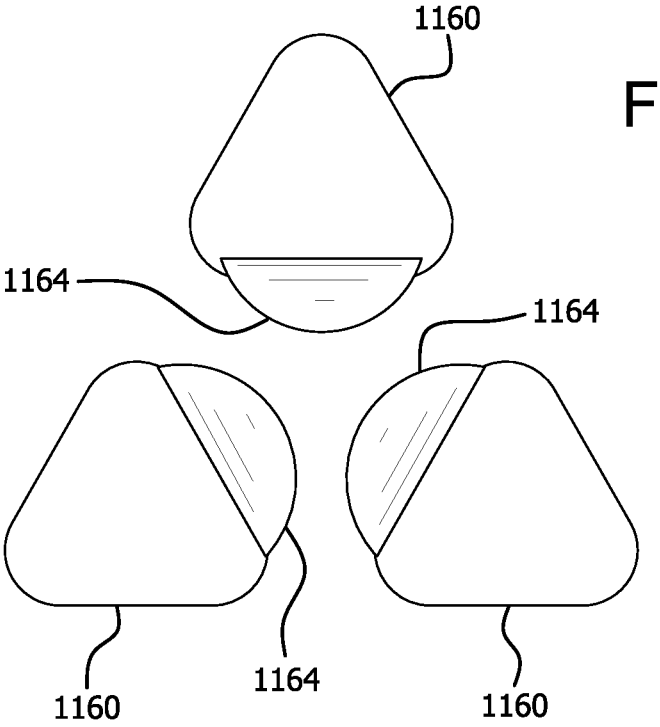
FIG. 19 is an end view triangular heat exchanger tubes with radiating heat exchange fins.
Figure 20:
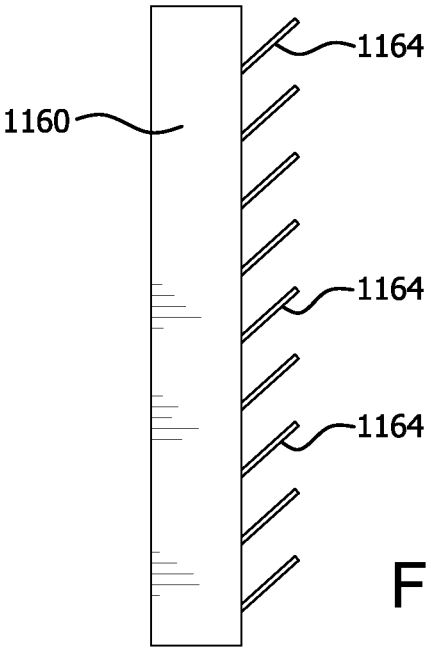
FIG. 20 is a plan view of a triangular heat exchanger tube with radiating heat exchange fins.

FIG. 19 is an end view triangular heat exchanger tubes 1160 with radiating heat exchange fins 1164. The radiating heat exchange fins 1164 can have varying shapes and sizes, and facilitate heat exchange between the tubes 1160 and the fluid flowing in the surrounding enclosed shell chamber. FIG. 20 is a plan view of the triangular heat exchanger tube with the radiating heat exchange fins 1164. The heat exchange fins 1164 also can be seen to serve as baffles, aiding in the redirection of flow of the surrounding fluid to facilitate heat exchange. Standard shell and tube heat exchanger baffles can also be used. Such baffles are known and extend from the interior wall of the elongated shell into the interior space (not shown), but do not extend across the entire width of the interior space of the elongated shell. Fluid flow in the enclosed shell chamber is redirected by such baffles to increase residence time and lengthen the flow path to facilitate heat transfer.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A shell and tube heat exchanger, comprising:

an elongated shell having first and second opposing ends and an open interior; a core dividing the open interior of the shell into first and second enclosed portions; a first tube fluid opening at the first end of the elongated shell, and a second tube fluid opening at the second end of the elongated shell;

an end plate in the first enclosed portion core between the first tube fluid opening and the core, and dividing the first enclosed portion into a first manifold portion and a first enclosed shell chamber, and a second end plate in the second end portion between the second tube fluid opening and the core, and dividing the second enclosed portion into a second manifold portion and a second enclosed shell chamber;

a first plurality of tubes extending from the first end plate, through the first enclosed shell chamber to the core, the first plurality of tubes having open ends communicating with the first manifold portion and open ends communicating with the second enclosed shell chamber;

a second plurality of tubes extending from the second end plate, through the second enclosed shell chamber to the core, the second plurality of tubes having open ends communicating with the second manifold portion and open ends communicating with the first enclosed shell chamber;

shell fluid openings at sides of the elongated shell, a first shell fluid opening communicating with the first enclosed shell chamber, and a second shell fluid opening communicating with the second enclosed shell chamber;

wherein the first enclosed shell chamber has a volume greater than the volume of the second enclosed shell chamber, and the first plurality of tubes are longer than the second plurality of tubes.

2. The shell and tube heat exchanger of claim 1, wherein the elongated shell has a long axis, and the end plates are angled relative to the long axis.

3. The shell and tube heat exchanger of claim 2, wherein the angle is from 15-75°.

4. The shell and tube heat exchanger of claim 2, wherein the core is angled at the same angle as the end plates.

5. The shell and tube heat exchanger of claim 1, wherein the tubes are polygonal with rounded corners and straight sides.

6. The shell and tube heat exchanger of claim 5, wherein the rounded corners have a radius r and a length L, and the ratio of r/L is less than 1.45.

7. The shell and tube heat exchanger of claim 6, wherein the ratio of r/L is from 0.05-0.55.

8. The shell and tube heat exchanger of claim 5, wherein the polygonal tubes are triangular shaped.

9. The shell and tube heat exchanger of claim 5, wherein the polygonal tubes are diamond-shaped.

10. The shell and tube heat exchanger of claim 5, wherein the polygonal tubes are square shaped.

11. The shell and tube heat exchanger of claim 1, wherein the tubes have circular cross section.

12. The shell and tube heat exchanger of claim 1, wherein the first tube fluid opening receives high temperature fluid, the second tube fluid opening receives low temperature fluid, the first shell fluid opening exhausts low temperature fluid, and the second shell fluid opening exhausts high temperature fluid.

13. The shell and tube heat exchanger of claim 1, wherein the first tube fluid opening exhausts low temperature fluid, the second tube fluid opening exhausts high temperature fluid, the first shell fluid opening receives high temperature fluid, and the second shell fluid opening receives low temperature fluid.

14. The shell and tube heat exchanger of claim 1, wherein the first tube fluid opening receives low temperature fluid, the second tube fluid opening receives high temperature fluid, the first shell fluid opening exhausts high temperature fluid and the second shell fluid opening exhausts low temperature fluid.

15. The shell and tube heat exchanger of claim 1, wherein the first tube fluid opening exhausts high temperature fluid, the second tube fluid opening exhausts low temperature fluid, the first shell fluid opening receives low temperature fluid, and the second shell fluid opening receives high temperature fluid.

16. The shell and tube heat exchanger of claim 1, wherein the core has a length that is from 5%-75% of the length of the elongated shell.

17. The shell and tube heat exchanger of claim 1, wherein the core has a minimum length that of 3 mm.

18. The shell and tube heat exchanger of claim 1, wherein the minimum core length is the minimum of 3 mm or 5% of the length of the elongated shell.

19. The shell and tube heat exchanger of claim 1, wherein the maximum core length is 75% of the length of the elongated shell.

20. A system for performing evaporation, comprising a shell and tube heat exchanger which comprises:

an elongated shell having first and second opposing ends and an open interior; a core dividing the open interior of the shell into first and second enclosed portions; a first tube fluid opening at the first end of the elongated shell, and a second tube fluid opening at the second end of the elongated shell;

an end plate in the first enclosed portion core between the first tube fluid opening and the core, and dividing the first enclosed portion into a first manifold portion and a first enclosed shell chamber, and a second end plate in the second end portion between the second tube fluid opening and the core, and dividing the second enclosed portion into a second manifold portion and a second enclosed shell chamber;

a first plurality of tubes extending from the first end plate, through the first enclosed shell chamber to the core, the first plurality of tubes having open ends communicating with the first manifold portion and open ends communicating with the second enclosed shell chamber;

a second plurality of tubes extending from the second end plate, through the second enclosed shell chamber to the core, the second plurality of tubes having open ends communicating with the second manifold portion and open ends communicating with the first enclosed shell chamber;

shell fluid openings at sides of the elongated shell, a first shell fluid opening communicating with the first enclosed shell chamber, and a second shell fluid opening communicating with the second enclosed shell chamber;

wherein the first enclosed shell chamber has a volume greater than the volume of the second enclosed shell chamber, and the first plurality of tubes are longer than the second plurality of tubes, and wherein the system is configured such that liquid enters the second plurality of tubes and is evaporated into a gas that enters the first enclosed shell chamber.

21. A system for performing condensation, comprising a shell and tube heat exchanger which comprises:

an elongated shell having first and second opposing ends and an open interior; a core dividing the open interior of the shell into first and second enclosed portions; a first tube fluid opening at the first end of the elongated shell, and a second tube fluid opening at the second end of the elongated shell;

an end plate in the first enclosed portion core between the first tube fluid opening and the core, and dividing the first enclosed portion into a first manifold portion and a first enclosed shell chamber, and a second end plate in the second end portion between the second tube fluid opening and the core, and dividing the second enclosed portion into a second manifold portion and a second enclosed shell chamber;

a first plurality of tubes extending from the first end plate, through the first enclosed shell chamber to the core, the first plurality of tubes having open ends communicating with the first manifold portion and open ends communicating with the second enclosed shell chamber;

a second plurality of tubes extending from the second end plate, through the second enclosed shell chamber to the core, the second plurality of tubes having open ends communicating with the second manifold portion and open ends communicating with the first enclosed shell chamber;

shell fluid openings at sides of the elongated shell, a first shell fluid opening communicating with the first enclosed shell chamber, and a second shell fluid opening communicating with the second enclosed shell chamber;

wherein the first enclosed shell chamber has a volume greater than the volume of the second enclosed shell chamber, and the first plurality of tubes are longer than the second plurality of tubes, and wherein the system is configured such that gas enters the first enclosed shell chamber and is condensed in the second plurality of tubes.

22. The shell and tube heat exchanger of claim 20, wherein the elongated shell has a long axis, and the end plates are angled relative to the long axis.

23. The shell and tube heat exchanger of claim 20, wherein the tubes are polygonal with rounded corners and straight sides.

24. The shell and tube heat exchanger of claim 20, wherein the tubes have circular cross section.

25. The shell and tube heat exchanger of claim 21, wherein the elongated shell has a long axis, and the end plates are angled relative to the long axis.

26. The shell and tube heat exchanger of claim 21, wherein the tubes are polygonal with rounded corners and straight sides.

27. The shell and tube heat exchanger of claim 21, wherein the tubes have circular cross section.

* * * * *